US008245870B2

(12) United States Patent
McKinney et al.

(10) Patent No.: US 8,245,870 B2
(45) Date of Patent: Aug. 21, 2012

(54) CONTAINER CAP WITH TETHER

(75) Inventors: Larry T. McKinney, Huntersville, NC (US); Jacob Connelly, Concord, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 599 days.

(21) Appl. No.: 12/406,949

(22) Filed: Mar. 18, 2009

(65) Prior Publication Data

US 2009/0236341 A1 Sep. 24, 2009

Related U.S. Application Data

(60) Provisional application No. 61/046,367, filed on Apr. 18, 2008, provisional application No. 61/037,679, filed on Mar. 18, 2008.

(51) Int. Cl.
*B65D 55/16* (2006.01)

(52) U.S. Cl. ..... 220/375; 220/703; 215/306

(58) Field of Classification Search ..... 220/375, 220/709, 705, 703, 737, 711, 725, 726, 728; 215/306, 237, 240, 258, 274, 278, 291
See application file for complete search history.

(56) References Cited

U.S. PATENT DOCUMENTS

| | | | | | |
|---|---|---|---|---|---|
| 591,668 | A | * | 10/1897 | Johnson | 215/306 |
| 1,301,676 | A | | 4/1919 | Fitzgerald | |
| 1,564,019 | A | * | 12/1925 | Pierce | 215/227 |
| 1,633,420 | A | | 6/1927 | Schlayer | |
| 1,672,466 | A | | 6/1928 | Oshman et al. | |
| 1,836,811 | A | * | 12/1931 | McNeal | 220/291 |
| 1,924,242 | A | * | 8/1933 | Kaye | 215/306 |
| 2,155,329 | A | | 4/1939 | Perdue | |
| 2,911,128 | A | | 11/1959 | Krautkramer | |
| 3,147,824 | A | | 9/1964 | Henderson | |
| 3,181,725 | A | | 5/1965 | Friedl | |
| 3,335,917 | A | | 8/1967 | Knight | |
| D226,555 | S | | 3/1973 | Weber et al. | |
| 4,127,211 | A | | 11/1978 | Zerbey | |
| 218,719 | A | | 8/1979 | Doyle | |
| 4,448,316 | A | | 5/1984 | Hiroshige | |
| 4,478,346 | A | | 10/1984 | Spong | |
| 4,491,520 | A | | 1/1985 | Jaye | |
| 4,526,289 | A | | 7/1985 | Schiemann | |
| 4,669,641 | A | | 6/1987 | Holmes | |
| 4,695,379 | A | | 9/1987 | Nohren, Jr. et al. | |
| 4,728,037 | A | | 3/1988 | Mainhardt | |
| 4,811,865 | A | | 3/1989 | Mueller, Jr. et al. | |
| 4,938,389 | A | | 7/1990 | Rossi et al. | |
| 5,044,512 | A | | 9/1991 | Giancaspro et al. | |

(Continued)

OTHER PUBLICATIONS

Product information for Bota of Boulder Outback Water Filtration System from www.botaofboulder.com (admitted prior art).

*Primary Examiner* — J. Gregory Pickett
*Assistant Examiner* — Ernesto Grano
(74) *Attorney, Agent, or Firm* — Lempia Summerfield Katz LLC

(57) ABSTRACT

A drinking container has a bottle with an open top, a cap assembly attachable to the bottle to cover the open top, and a drinking spout with a top opening on the cap assembly. A spout cover is removably fitted on the top opening of the drinking spout. A flexible tether is connected to the spout cover and to the cap assembly or the bottle. The tether is looped unto itself permitting the spout cover and a portion of the tether to be extended to reach the top opening and to be retracted withdrawing the spout cover to a position remote from the drinking spout.

10 Claims, 10 Drawing Sheets

U.S. PATENT DOCUMENTS 5,045,195 A 9/1991 Spangrud et al.
5,090,583 A 2/1992 Hoffman et al.
5,122,272 A 6/1992 Iana et al.
D337,939 S 8/1993 Smith
5,238,153 A 8/1993 Castillo et al.
D339,503 S 9/1993 Callaway
D342,449 S * 12/1993 Mattheis ..... D9/446
5,273,649 A 12/1993 Magnusson et al.
5,417,860 A 5/1995 Kay
5,431,813 A 7/1995 Daniels
D361,922 S 9/1995 Van Dyk
5,533,767 A 7/1996 Georgopoulos et al.
5,545,315 A 8/1996 Lonneman
5,573,525 A 11/1996 Watson et al.
5,601,199 A 2/1997 Marty
5,605,257 A 2/1997 Beard
5,609,759 A 3/1997 Nohren, Jr. et al.
5,635,079 A 6/1997 Becking, II
5,681,463 A 10/1997 Shimizu et al.
D391,448 S 3/1998 Winer et al.
5,840,185 A 11/1998 Hughes et al.
5,914,045 A 6/1999 Palmer et al.
5,919,365 A 7/1999 Collette
5,928,512 A 7/1999 Hatch et al.
D413,067 S 8/1999 Haley
6,004,460 A 12/1999 Palmer et al.
6,079,589 A 6/2000 Matsuyama et al.
6,117,319 A 9/2000 Cranshaw
6,136,189 A 10/2000 Smith et al.
6,153,096 A 11/2000 Nonren, Jr.
6,165,362 A 12/2000 Nohren, Jr. et al.
6,193,886 B1 2/2001 Nohren, Jr.
6,200,471 B1 3/2001 Nohren, Jr.
6,221,416 B1 4/2001 Nohren, Jr.
D442,434 S 5/2001 Klima et al.
6,227,399 B1 5/2001 Angus et al.
D443,337 S 6/2001 Mark et al.
6,395,170 B1 5/2002 Hughes et al.
6,468,435 B1 10/2002 Hughes et al.
6,478,180 B1 11/2002 Dehn, Sr.
6,565,743 B1 5/2003 Poirier et al.
6,569,329 B1 5/2003 Nohren, Jr.
6,656,350 B2 12/2003 Kitakaze
D496,559 S 9/2004 Bodum
D501,362 S 2/2005 Gauss
6,919,025 B2 7/2005 Cluff et al.
D515,869 S 2/2006 Mills et al.
7,040,499 B1 5/2006 Reif
D528,862 S 9/2006 Li
D528,910 S 9/2006 Kingsley
D529,338 S 10/2006 Poulson
D536,929 S 2/2007 Kingsley
D537,676 S 3/2007 Kingsley
D555,428 S 11/2007 Tulett
D556,575 S 12/2007 Nusbaum et al.
D565,353 S 4/2008 Roth et al.
D565,416 S 4/2008 Lepoitevin
D566,468 S 4/2008 Sandy
D588,871 S 3/2009 Miller et al.
D591,160 S 4/2009 Windmiller
1,019,171 A1 3/2012 Melville-Hamilton
2004/0164079 A1 8/2004 Alois
2005/0199631 A1 9/2005 Alois
2005/0247714 A1 11/2005 Backes et al.
2005/0274741 A1 12/2005 Cho
2008/0041809 A1* 2/2008 Shek ..... 215/315
2008/0087624 A1* 4/2008 Buckley ..... 215/230

* cited by examiner

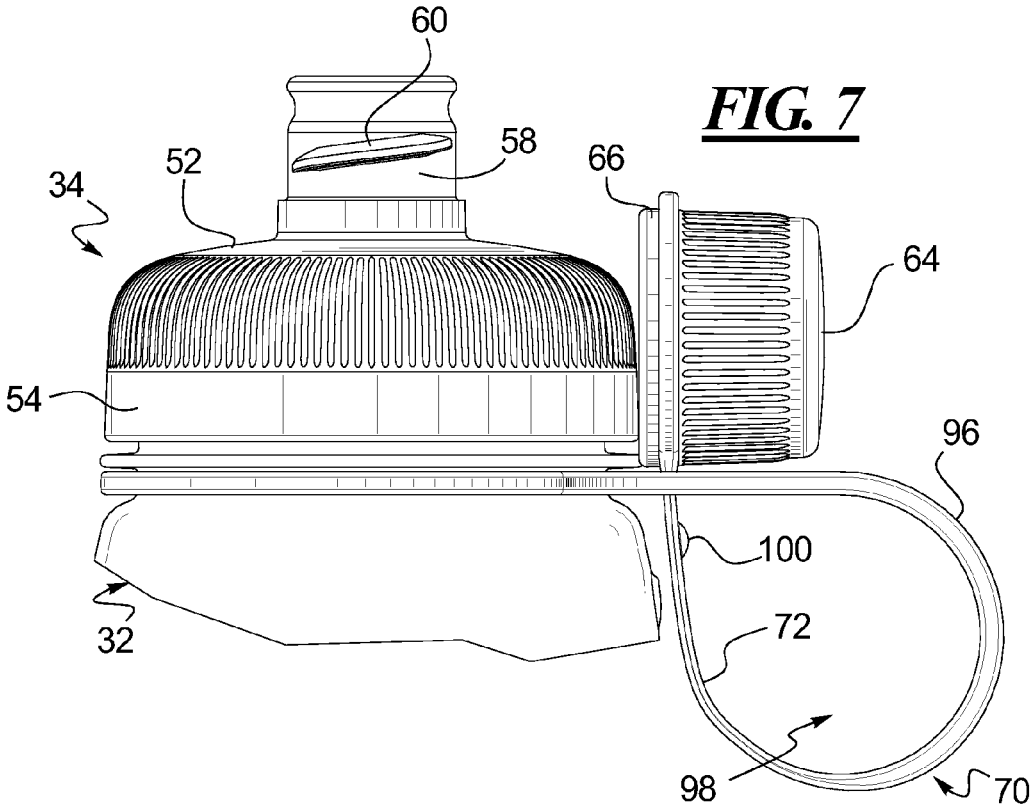
FIG. 7
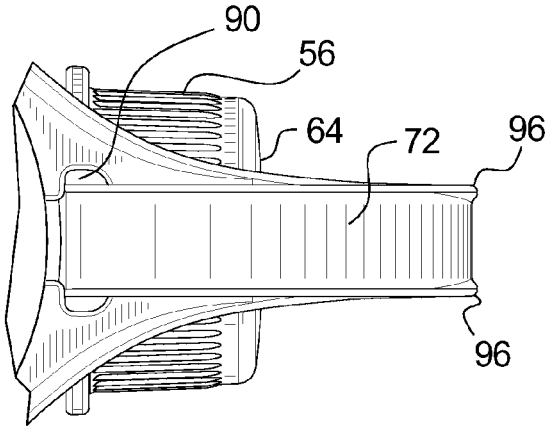
FIG. 8
FIG. 9
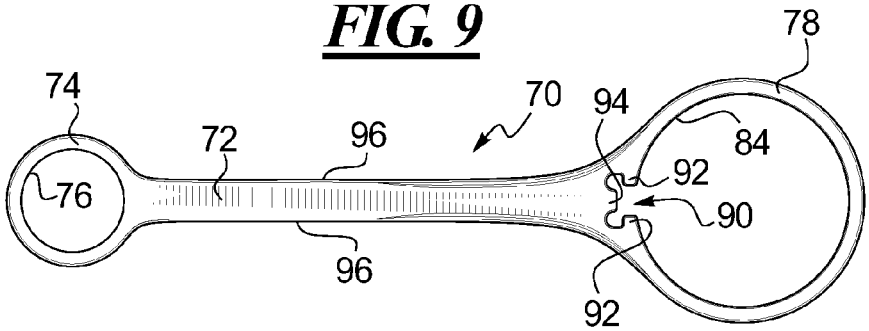

FIG. 10
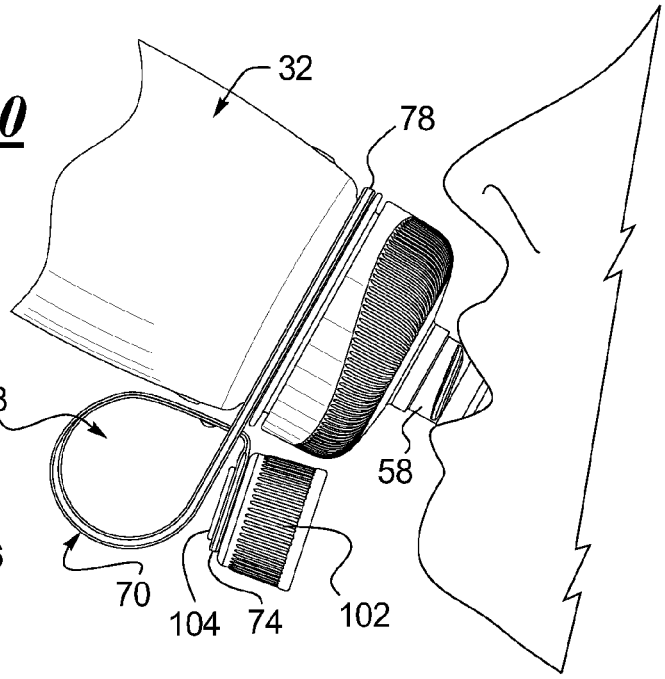
FIG. 11
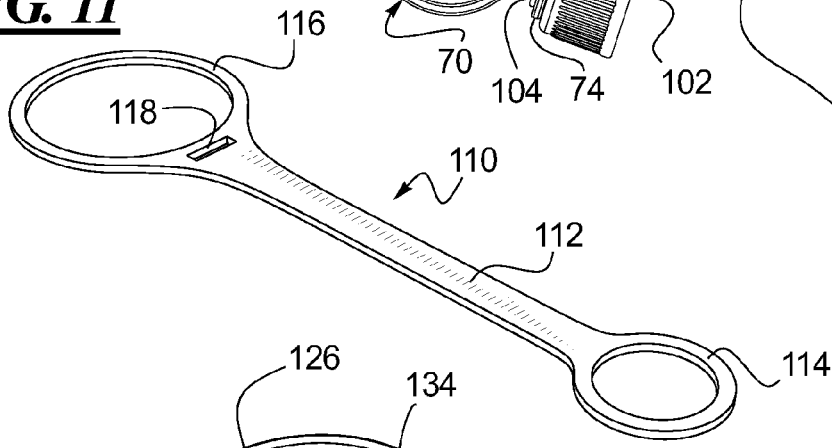
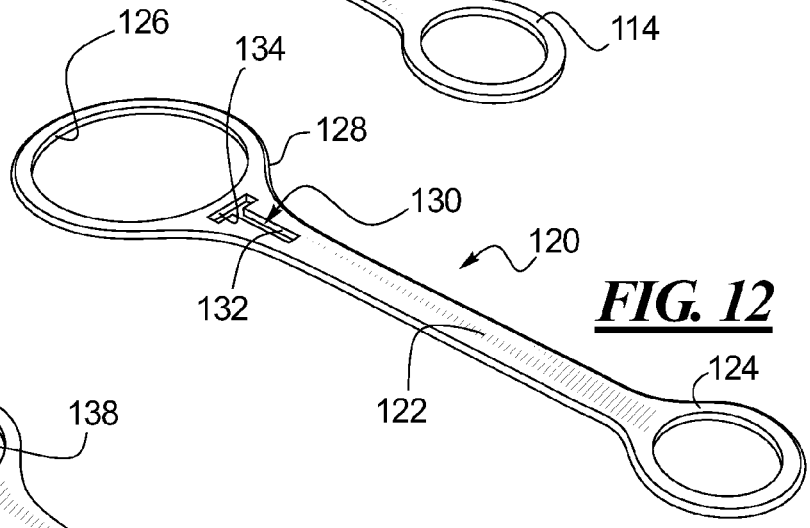
FIG. 12
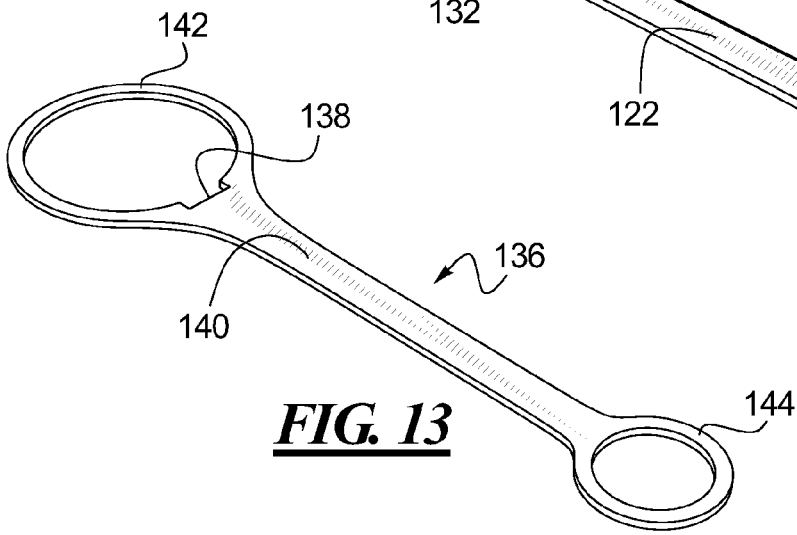
FIG. 13

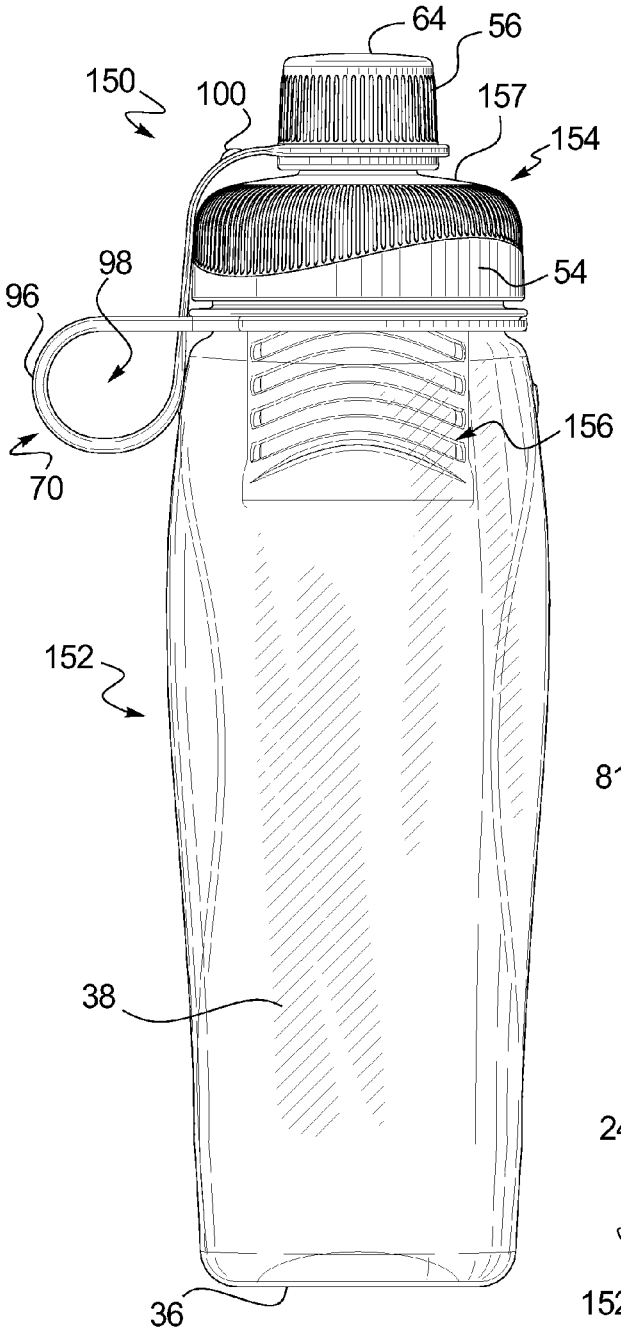
FIG. 14
FIG. 15
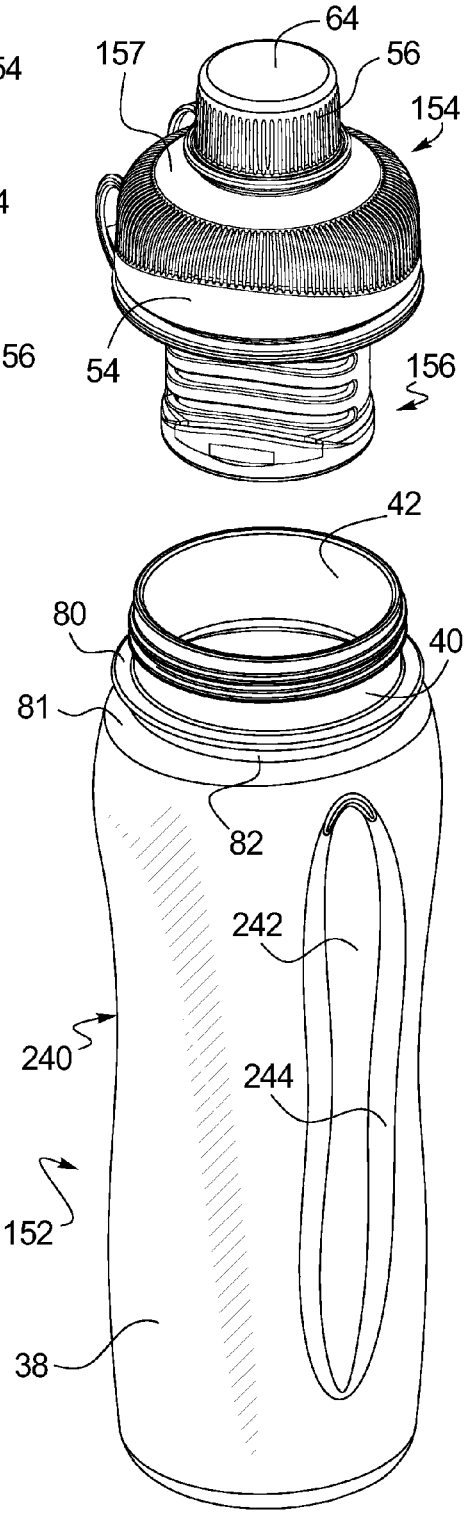

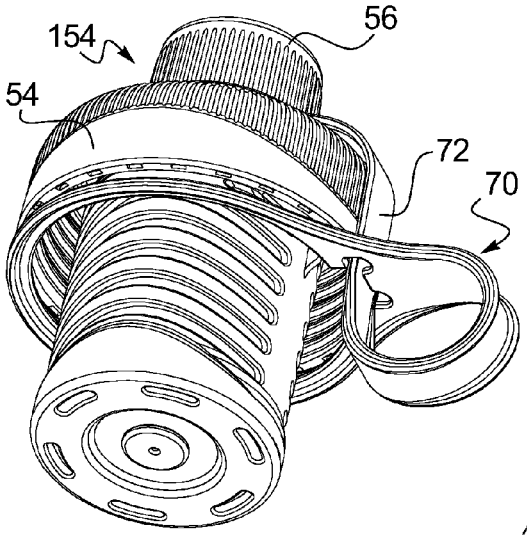
FIG. 16
FIG. 18
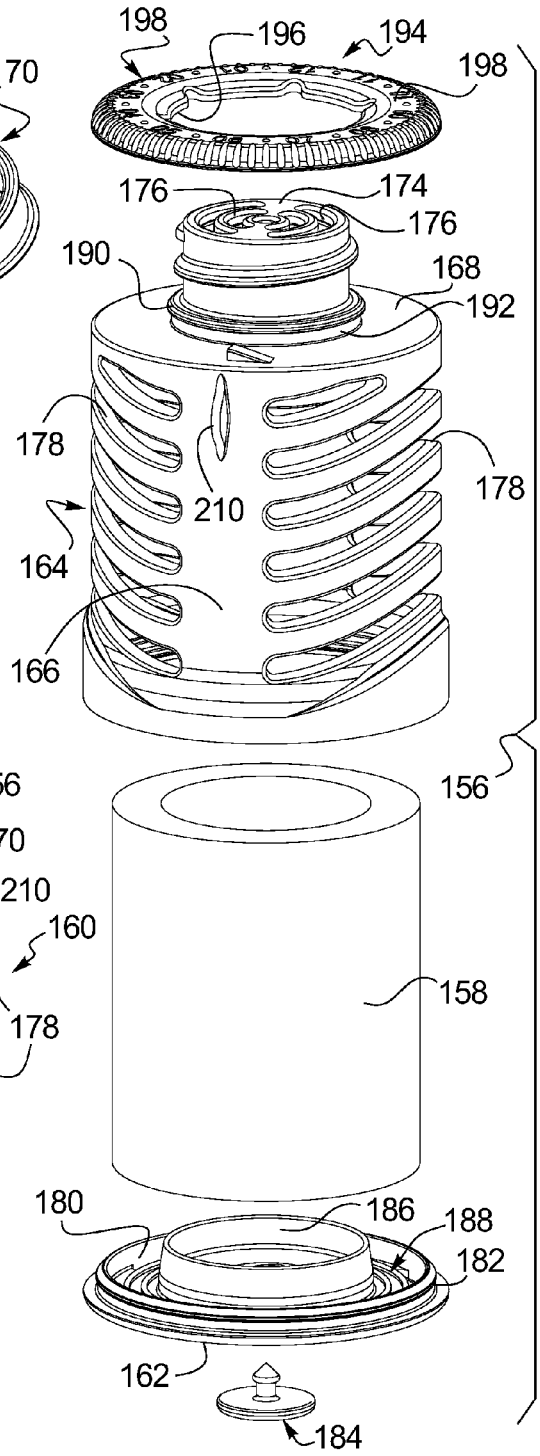
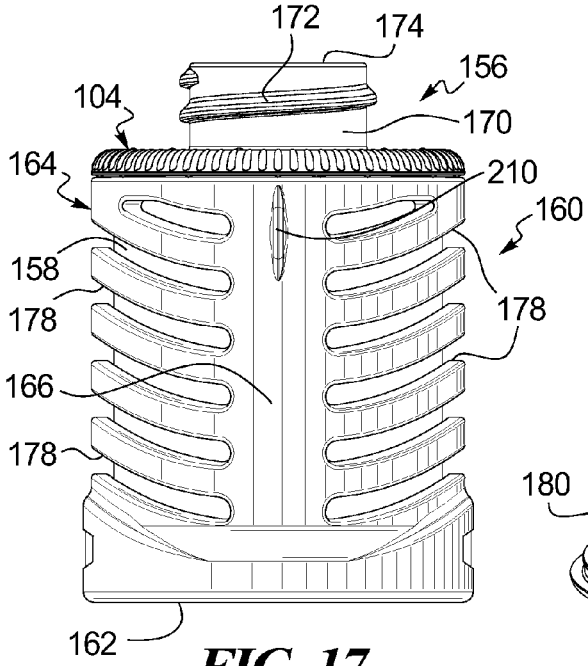
FIG. 17

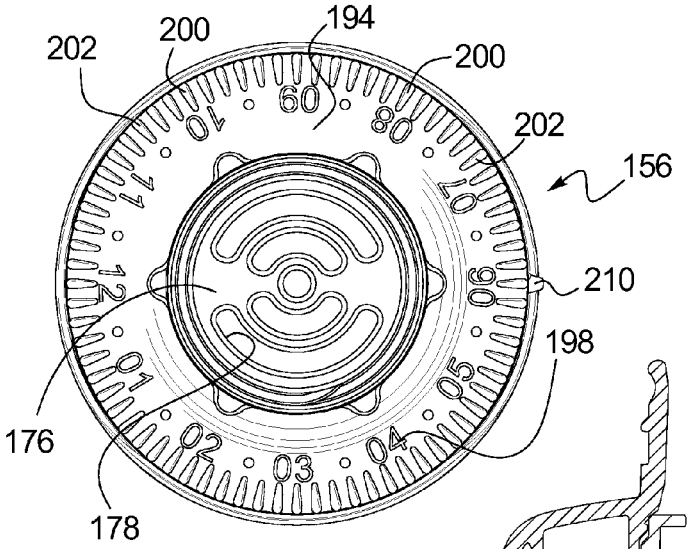
FIG. 19
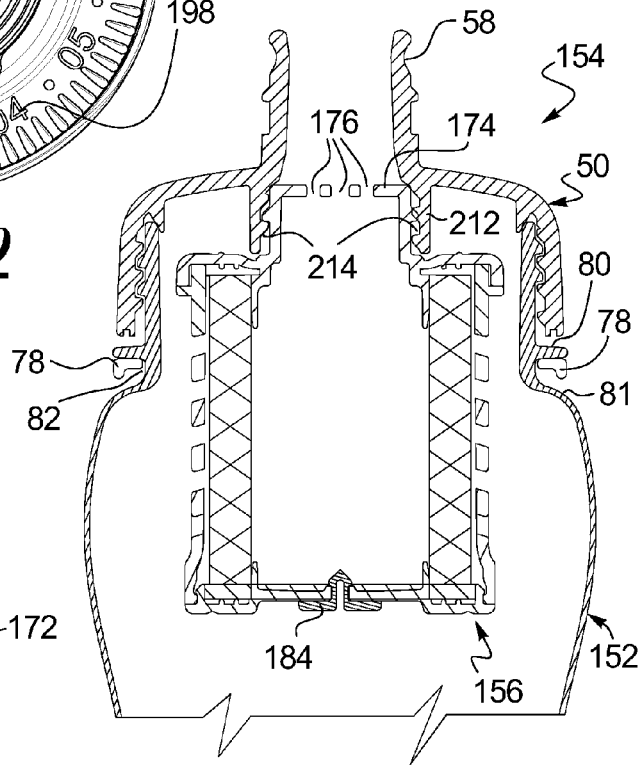
FIG. 21
FIG. 20
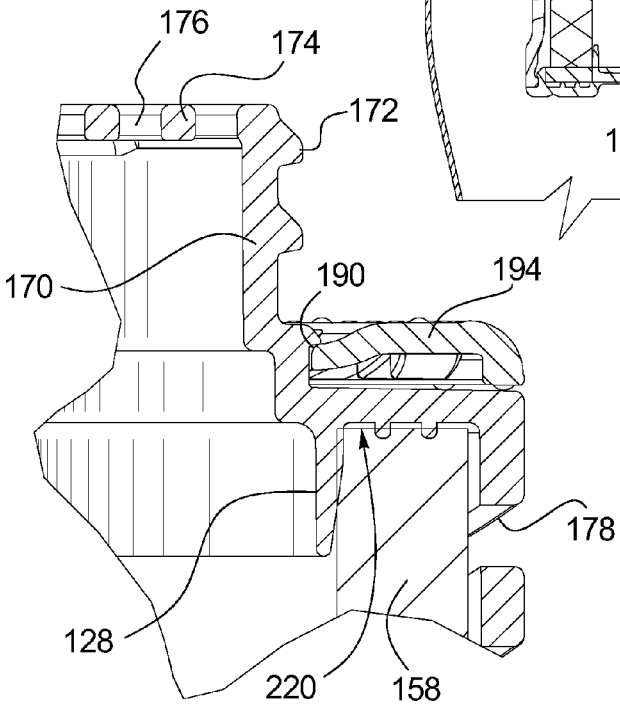

FIG. 22
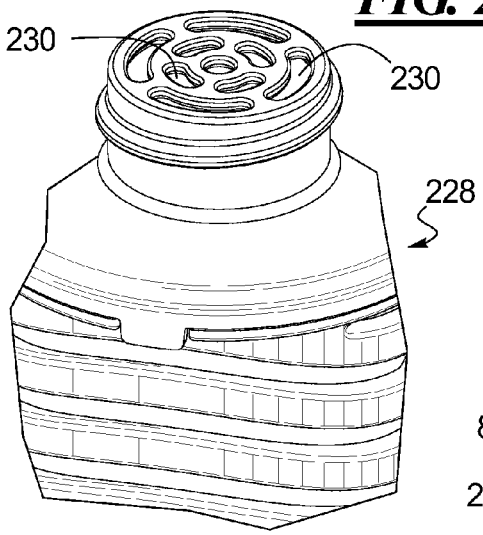
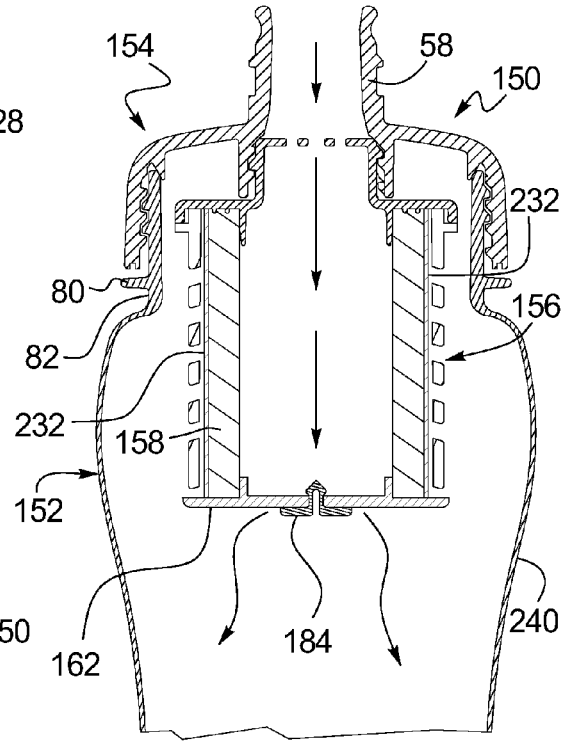
FIG. 24
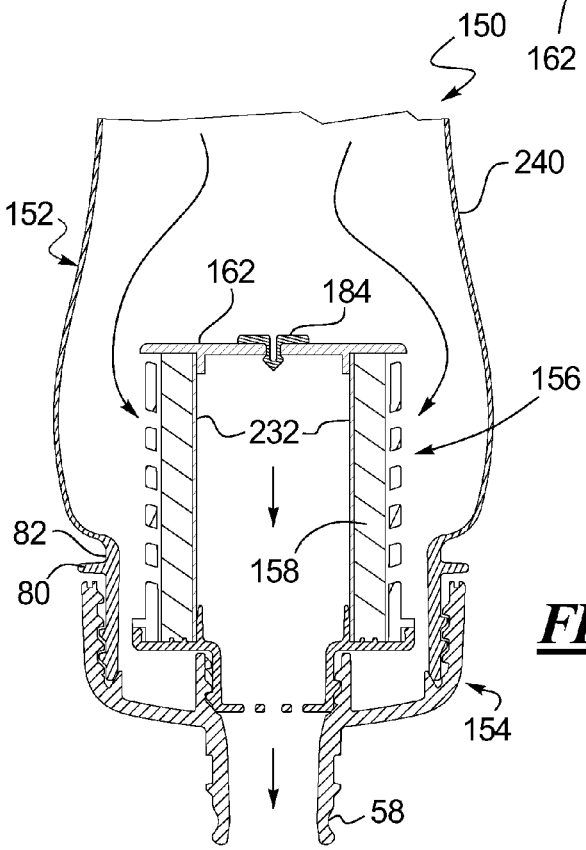
FIG. 23

FIG. 25
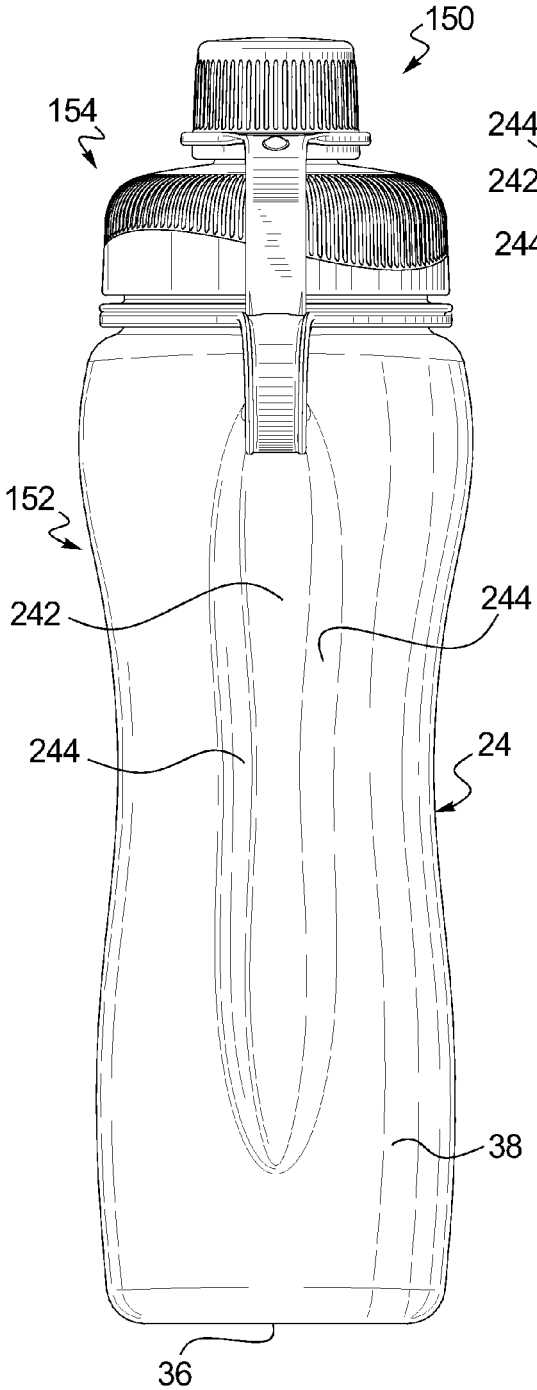
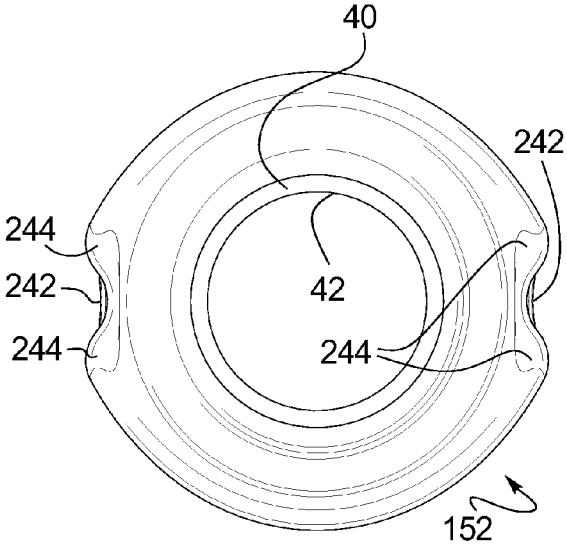
FIG. 26

CONTAINER CAP WITH TETHER

RELATED APPLICATION DATA

This patent is related to and claims priority benefit of U.S. provisional patent application Ser. Nos. 61/037,679 filed Mar. 18, 2008 and 61/046,367 Apr. 18, 2008, each of which is incorporated herein by reference in its entirety.

BACKGROUND OF THE INVENTION

1. Field of the Disclosure

The present disclosure is generally directed to reusable drinking containers and more particularly to a personal drinking container having a cap assembly with a tether.

2. Description of Related Art

Personal drinking containers are known in the art and can have a strap or tether to retain a cap assembly on the bottle of the container. Some cap straps can provide dual functions. The straps both retain the cover or cap assembly connected to the bottle and can create a finger hold for carry the container. Some known straps are quite stiff and configured and arranged to keep the cap close the mouth of the bottle. As a result, the cap can interfere with drinking from and refilling the bottle. Such a cap must typically be held away from the user's face by hand in order for a user to drink from the beverage container opening. Other known straps are limp or soft and completely flexible. The cap tethered by such a strap must still be held out of the way because the cap can swing about or dangle and interfere with drinking or refilling.

Some known drinking containers have bottles made of a resilient flexible material, such as polyethylene or polypropylene. Many of these flexible bottles make use of a one-way valve or drinking spout configured to allow the user to squeeze the bottle repeatedly to dispense the contents. Many of these bottles, once squeezed, do not rebound very quickly. Significant return air flow is thus required through the drinking spout to aid in bottle rebound. Other bottles are made of a more rigid material, such as polycarbonate or PVC, and cannot be squeezed. Many of these types of bottles require the user to drink from the wide mouth opening of the bottle.

Additionally, users may wish to fill or refill a bottle when away from a reliable source of potable water. Thus, several known water bottles are configured to include a filtration system or replaceable filter. Some portable water filtration systems may not be easily and quickly used "on the go." Some require that the water be manually pumped through a filter to a temporary storage container before dispensing for drinking. Others do have a charcoal filter that can be employed with the bottle. These types of filters often deposit larger chunks of filter material and/or much smaller "fines" of the filter material in the stream of water to be consumed.

Consumers may not be certain when a filter medium should be replaced. Virtually all filter media will eventually reach a point where the filtering capability is spent. The filter media when spent will either no longer function to filter out the desired chemicals and contaminants or at least become ineffective in doing so. Additionally, the filter media and structure typically inhibits or decreases free flow of water when dispensed from the bottle. Some application of positive pressure is often required to dispense the water. Further, the filter construction and media can inhibit the return air flow back into the bottle once water is dispensed from the bottle.

SUMMARY OF THE INVENTION

A drinking container is disclosed herein that has a bottle with an open top, a cap assembly attachable to the bottle to cover the open top, and a drinking spout with a top opening on the cap assembly. A spout cover is removably fitted on the top opening of the drinking spout. A flexible tether is connected to the spout cover and to the cap assembly or the bottle. The tether is looped unto itself permitting the spout cover and a portion of the tether to be extended to reach the top opening and to be retracted withdrawing the spout cover to a position remote from the drinking spout.

The tether in one example has an elongate band, a large diameter hoop on one end of the band, and a relatively smaller diameter hoop on the opposite end of the band, the one end connected to the bottle or the cap assembly and the other end connected to the spout cover.

The tether in one example is configured to retain the spout cover against the band adjacent the cap assembly in the remote position.

The spout cover in one example can rotate relative to a hoop of the tether to which it is connected. The bottle in one example can rotate relative to a hoop of the tether to which it is connected.

One end of the tether in one example is threaded through a band of the tether. In one example, the one end is threaded through a slot or shaped perforation in the band. In one example, the one end is threaded through a bottle connecting hoop on the other end of the band and is seated in a notch in an inner edge of the hoop.

The tether in one example is connected at one end to a neck of the bottle and to the spout cover at the opposite end of the tether.

The cap assembly in one example has a replaceable water filter connected to a cap of the cap assembly.

The tether in one example forms a loop within a tether band, the loop becoming larger when the spout cover is retracted and smaller when the spout cover is extended.

The tether in one example retains the cap assembly connected to the bottle when the cap assembly is removed from the bottle.

The tether in one example has ribs formed along a band of the tether to render the tether less flexible and more resilient.

BRIEF DESCRIPTION OF THE DRAWINGS

Objects, features, and advantages of the present invention will become apparent upon reading the following description in conjunction with the drawing figures, in which:

FIG. 7 shows a side view of the upper bottle and cap assembly in FIG. 6.

FIG. 8 shows a bottom view of part of the opened cap assembly in FIG. 7.

FIG. 9 shows a plan view of one example of a cap tether for the cap assembly in FIGS. 1-8 and constructed according to the teachings of the present invention.

FIG. 10 shows another example of a drinking container with an alternate cap and tether arrangement and a user drinking from the container.

FIGS. 11-13 show perspective views of alternate tether examples.

FIG. 14 shows a side view of another example of a drinking container according to the teachings of the present invention.

FIG. 15 shows a top perspective exploded view of the drinking container including the bottle and cap assembly in FIG. 14.

FIG. 16 shows a bottom perspective view of the cap assembly in FIG. 15.

FIG. 17 shows a side view of a filter assembly for the cap assembly in FIGS. 14-16.

FIG. 18 shows a top perspective exploded view of the filter assembly in FIG. 17.

FIG. 19 shows a top view of the filter assembly in FIG. 17.

FIG. 20 shows a cross-section taken along lines A-A in FIG. 19 of a top part of the filter assembly.

FIG. 21 shows a vertical cross-section taken along lines B-B of the container assembly in FIG. 14 and with the cap opened.

FIG. 22 shows a top perspective view of part of another example of a filter assembly having a different top grate pattern.

FIG. 23 shows a cross-section similar to that in FIG. 21 with the drinking container inverted showing the water flow path and showing an alternate filter construction.

FIG. 24 shows the cross-section in FIG. 23 but with the drinking container upright and showing the return air flow path.

FIG. 25 shows an alternate side view of the drinking container in FIGS. 1 and 2.

FIG. 26 shows a top view of bottle of the drinking container in FIGS. 1, 2, and 25.

DETAILED DESCRIPTION OF THE DISCLOSURE

The disclosed personal drinking container solves or improves upon one or more of the above-noted and/or other problems and disadvantages of prior known drinking containers. The drinking container of the present disclosure has a cap assembly comprising a container cap, a spout cover, and a flexible tether or strap that turns in on itself or loops through itself. The flexible tether arrangement provides a convenient retention means for the spout cover and the container cap during drinking and during filling of the bottle. The tether can perform the dual functions of prior known tethers of providing a handhold, finger loop, or belt (hanging) loop and for connecting the cap assembly to the bottle. However, the tether can also retain the spout cover of the cap assembly separately attached to the drinking container or the cap assembly. Also, the tether securely holds the spout cover out of the way or remote from the spout for drinking from the bottle without the user having to manually holding the spout cover out of the way.

In one example, the cap assembly of the disclosed drinking container can also have a filter assembly for removing impurities in water that passes through the filter assembly during use of the container. The disclosed filter assembly provides convenient on-the-go filtration of water from nearly any accessible source of water. The filter assembly can employ flow grates and/or a paper barrier surrounding the filter media to filter out chunks and fines expelled from the filter media. The filter assembly can also employ a one-way check valve along the water flow path to permit the desired water flow and allow return air flow to the evacuated bottle.

In one example, the bottle of the disclosed drinking container can have a shape that enhances the ability of the bottle to be squeezed and to rebound from same. The bottle can have a curved shape and be formed of a resiliently flexible material having a memory. Also, the contours of the bottle can be configured so the bottle is comfortable to hold, so the necessary squeeze force is reduced, and so the bottle rebounds quickly and consistently after being squeezed to dispense water from the bottle.

In one example, the filter assembly can have a date or replacement time indicator. The indicator can be such that a user is able to determine when it might be time to change out the filter media. The indicator can indicate to the user when the filter media was installed, when the filter media should be changed, or both.

Figure 1:
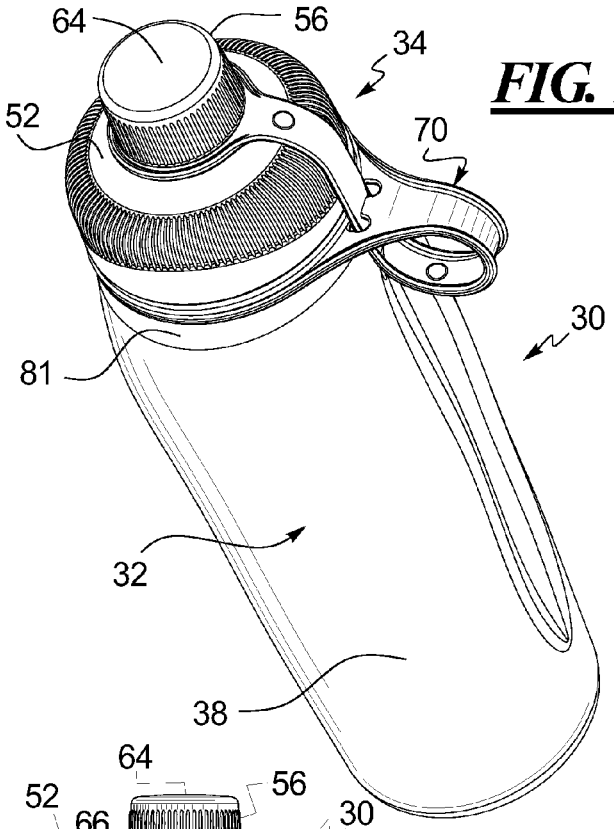
FIG. 1 shows a top perspective view of one example of a drinking container according to the teachings of the present invention and with a cap assembly closed.
Figure 2:
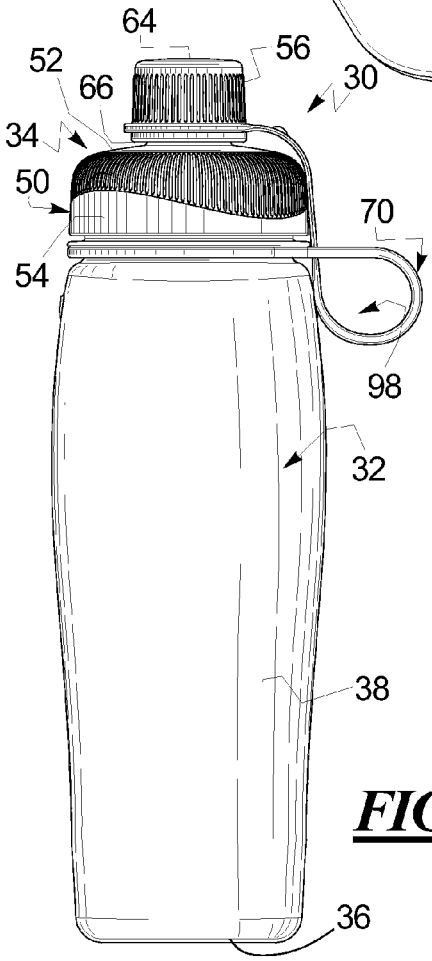
FIG. 2 shows a side view of the drinking container in FIG. 1.
Figure 3:
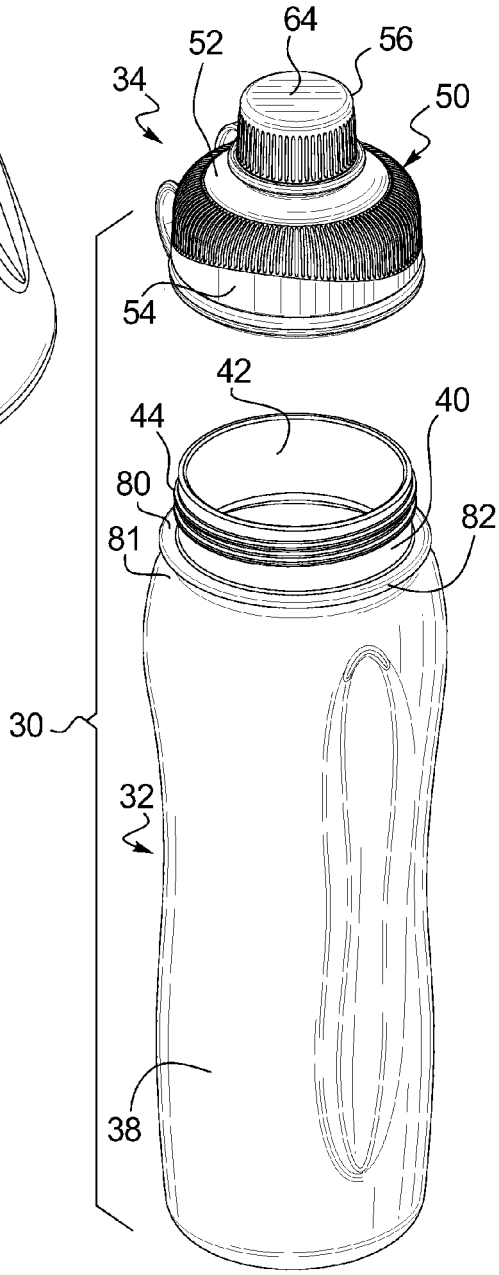
FIG. 3 shows a top perspective exploded view of the drinking container including the bottle and cap assembly in FIGS. 1 and 2.
Figure 4:
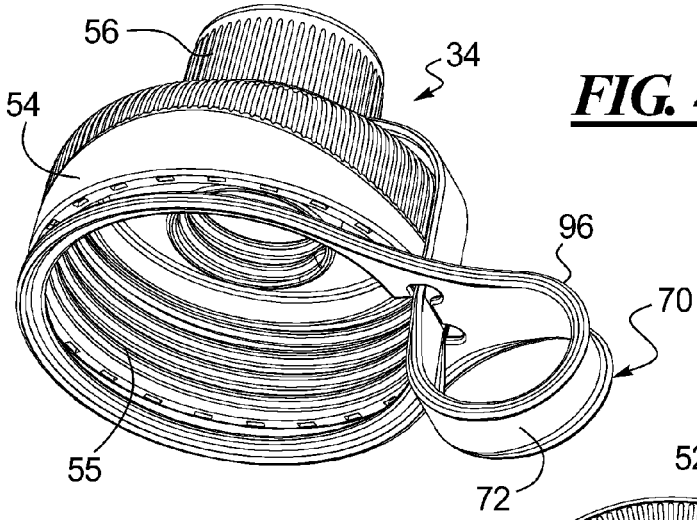
FIG. 4 shows a bottom perspective view of the cap assembly in FIG. 3.

Turning now to the drawings, FIGS. 1-3 show one example of a drinking container 30 constructed in accordance with the teachings of the present invention. The drinking container 30 generally has a bottle 32 that is capable of holding water or other beverages and has a cap assembly 34 configured to cover the bottle. As generally shown in FIGS. 1-3, the bottle 32 has a closed bottom 36, an upstanding side wall 38 extending up from a perimeter of the bottom, and an open top. In this example, the open top of the bottle 32 is formed by an upstanding neck 40 having a top edge that defines a fill opening 42 into an interior of the bottle. An exterior surface of the neck 40 has mechanical male threads thereon. As shown in FIG. 4, the cap assembly 34 has a cap 50 with a top panel 52 and a depending skirt 54 extending down from a perimeter of the top panel. An interior surface of the skirt 54 has female mechanical threads 55 whereby the cap assembly 34 can be screwed onto on the neck of the bottle when installed.

Figure 5:
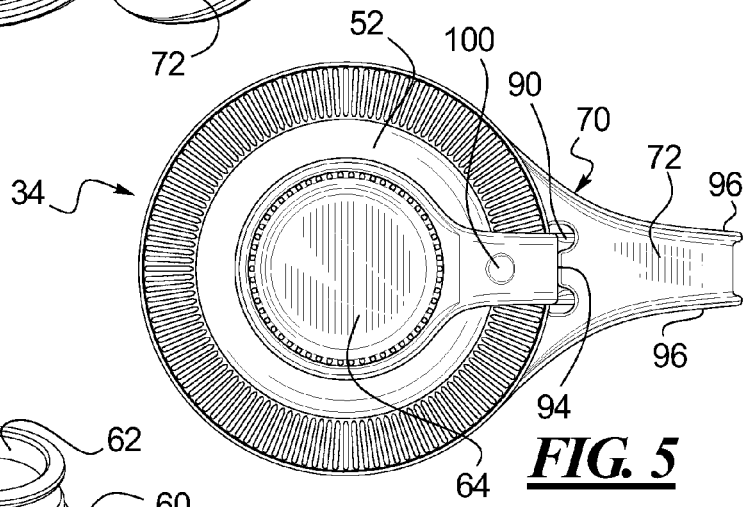
FIG. 5 shows a top view of the cap assembly in FIGS. 3 and 4.

As best illustrated in FIGS. 1, 2, 4, and 5, the cap assembly 34 also includes a spout cover 56 that can be tethered to either the cap 50 or to the neck 40 of the bottle. In one example, the cap assembly 34 can be tethered to the bottle 32, as is described below, so that the cap assembly can be completely removed from the neck 40 in order to refill the bottle via the fill opening 42 while maintaining connection of the cap assembly to the bottle so that it doesn't become lost. In another example, the spout cover 56 can alternatively be tethered to the cap 50, if desired. In FIGS. 2, 4, and 5, the cap assembly 34 is removed from the bottle 32 along with a portion of the tether otherwise connected to the bottle neck 40 in order to clearly show separation of the two components of the drinking container 30.

Figure 6:
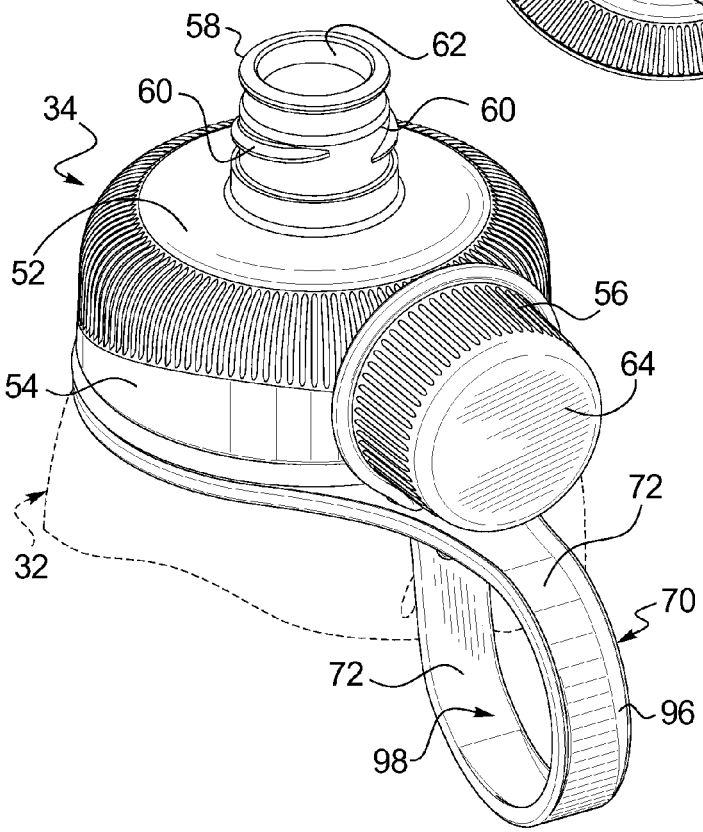
FIG. 6 shows a top perspective view of the upper bottle and the cap assembly opened.

As best illustrated in FIGS. 6 and 7, in this example a dispenser spout 58 or dispenser orifice is centrally positioned on the top panel 52 of the cap 50. The spout 58 is hollow and has a top opening 62 to provide a flow passage through the cap assembly 34. The spout cover 56 can be selectively attached to and removed from the drinking spout 58 on the cap 50. In this example, the drinking spout 58 is an elongate cylinder with exterior male mechanical threads 60 on its outer surface. Though not shown herein, the interior annular surface of the spout cover 56 can have corresponding female mechanical threads, similar to the interior of the cap skirt 54 in this example. The spout cover 56 can screw onto the drinking spout 58 to close off the top opening 62.

As shown in FIGS. 6-8, the spout cover 56 is also generally a cylinder with one closed end 64 that covers the top opening 62 when installed, such as in FIGS. 1-3. A collar 66 surrounds a bottom open end of the spout cover 56 and a groove (not shown) is formed spaced upward form the collar.

As shown in each of FIGS. 1, 2, and 4-8, a tether 70 connects the spout cover 56 to either the cap assembly 34 or to the bottle 32. In this example, as noted above, the tether 70 connects the spout cover 56 to the bottle neck 40. FIG. 9 illustrates a plan view of the tether 70 in this example. The tether 70 has a thin body or band 72 that is elongate and resiliently flexible. The band 72 has a relatively narrow width but the width is much wider than a thickness of the band in this example of the tether. A spout connector hoop 74 is provided at one end of the band 72. In this example, the spout hoop is sized to interferingly fit over the collar 66 on the spout cover 56 and seat in the groove (not shown) adjacent the collar. The inner edge 76 of the spout hoop 74 is sized to loosely fit in the groove so that the spout cover 56 can rotate relative to the connector hoop. Thus, the spout cover 56 in this example can be twisted or rotated within the hoop 74 in order to screw the spout cover on or off of the drinking spout 58.

In this example, a bottle connector hoop 78 is disposed at the opposite end of the band 72 on the tether 70, as shown in FIG. 9. As shown in FIGS. 2 and 3, the bottle 32 includes an annular rib or flange 80 extending circumferentially around and projecting outward from the base of the neck 40, but above a top surface 81 of the bottle. A groove 82 is formed beneath the rib or flange 80. An inner edge 84 of the bottle hoop 78 is also sized to interferingly fit over the rib or flange 80 but to loosely fit in the groove 82. Thus, the tether and bottle can also rotate relative to one another in this example. Though not directly illustrated herein, the cap 50 is not directly tethered to the bottle 32. Instead, the cap 50 is tethered to the bottle via the spout cover 56 and the tether 70. If the spout cover 56 is detached from the cap 50, and the cap is then removed from the bottle, the cap 50 will not be tethered to the bottle in this example. In an alternate example, the hoop 78 can be connected to the cap 50 instead of the bottle. However, then the cap assembly can be removed entirely from the bottle as depicted in FIG. 3.

The tether 70 in this example also includes an open notch 90 at the end of the band 72 and facing into the bottle connector hoop 78. Two lobes of the notch extend away from one another and away from the entry into the notch 90 to form three flexible fingers within the notch. Two of the flexible fingers 92 extend laterally toward one another at the notch entry and one of the fingers 94 projects in a lengthwise direction from the end of the band toward the notch entry. Also in this example, a pair of ribs 96 is positioned one each along opposite edges of the band 72, at least near a central portion of the tether 70. The tether 70 in this example can be formed from a flexible, resilient plastic material that has some rigidity and memory, once formed. The tether in this example can also be molded in the flat or planar configuration shown in FIG. 9.

As can be seen in FIGS. 1, 2, and 4-8, the tether band 72 can be looped or bent unto itself or otherwise threaded through itself to create a loop 98, which can change in diameter. To create the loop 98, the band 72 can be bent such that the spout connector hoop 74 is passed through the opening in the bottle hoop 78. The band 72 section nearer the spout hoop 74 can be forced into the notch 90 and retained therein by the two laterally extending fingers 92, spaced apart narrower than a width of the band. The longitudinally extending finger 94 can apply pressure against a surface of the band 72, forcing the band to bear slightly against the latterly extending fingers 92 to assist in retaining the band 72 in the notch 90. The ribs 96 can be provided to assist the band in resisting flexibility and bending and to impart some resiliency to the band. The ribs 96, and the band material itself, can be chosen and designed to bias the band toward its elongate, straight configuration in FIG. 9.

With the tether 70 looped or threaded through itself as described above in this example, the size of the loop 98 created in the band body 72 can be varied by pulling on the spout cover 56 attached to the spout connector loop 74. As shown in FIGS. 1 and 2, the spout cover 56 and free end of the band 72 can be pulled to reach the drinking spout 58 and decrease the size of the loop 98. In this position, the spout cover 56 can be installed on the drinking spout 58 to close the spout. With the spout cover 56 removed from the spout as in FIG. 6, for example, the free end of the band 72 can be withdrawn to increase the size of the loop 98. This in turn will draw the spout cover 56 downward toward the notch 90 near the bottle hoop 78. As shown in FIGS. 6 and 7, the spout cover 56 will be retained in this remote position adjacent the cap skirt 54 and the band 72 until it is again pulled upward to cover the drinking spout 58. The band configuration will be biased toward the larger loop 98 size and the straighter condition and thus will be inclined to readily retain the spout cover 56 in the remote position until a user reattaches the spout cover.

As shown in FIGS. 5 and 6, the band 72 can include one or more optional projecting nubs or bumps 100 along a length of the band and spaced from the spout hoop 74. The nub 100 illustrated in the figures can be provided to seat below the longitudinally projecting finger 94 to further assist in retaining the spout cover 56 in this remote position. This can assure a user to freely drink from the drinking spout 58 without interference from the spout cover 56 or tether 70. A plurality of these nubs 100 can be provided along the length of the band to allow a user to selectively position the spout cover 56 relative to the band and notch 90 and will assist in retaining that selected position. In addition, one of these nubs can be provided nearer the bottle hoop 78 to assist the tether in holding the band 72 in position when the spout cover 56 is installed on the spout 58.

FIG. 10 illustrates a user drinking from a drinking container 30 wherein the container includes the above-described tether 70. However, in this example, an alternate spout cover 102 is shown. The spout hoop 74 of the tether 70 is connected to a top end of the spout cover and not the bottom end as in the prior example. The tether 70 can be attached to the spout cover 102 by a plastic "button" component 104 and perform as intended. The button 104 can be ultrasonically welded to the spout cover 102. In either embodiment herein, the bottle 32 and the spout covers 56, 102 can be free to rotate within the tether hoop 74. FIG. 10 illustrates that the configuration and construction of the cap assembly 34 in the disclosed example can vary. As noted above, the bottle hoop 78 can be replaced by a cap connector hoop that attaches the tether 70 to a skirt of the cap, if desired, instead of the bottle. As an alternate means of closure, the spout cover 56 or 102 and the drinking spout 58 can have a snug snap-fit type closure instead of a screw-on closure. Thus, the spout cover 56 or 102 need not necessarily rotate relative to the tether 70. The same can be said for the connection between the tether and the bottle 32 or the cap 50. The hoop and groove connections can thus be different from that shown and described above.

FIG. 10 is also provided to illustrate that a user can freely drink from the disclosed drinking container 30 without interference from the tether 70 or the spout cover 56 (or 102) in accordance with the teachings of the present invention. With the remote position of the spout cover and the taught condition of the tether, the spout cover and tether will remain in this remote configuration as the user drinks.

FIGS. 11-13 illustrate alternate examples of tethers constructed within the spirit and scope of the present invention. In FIG. 11, a tether 110 is similarly constructed to the tether 70 described above. In this example, the tether 110 has a simple flat profile band 112, a spout connector hoop 114 at one, and a bottle connector hoop 116 at the other end. In this example, the previously described notch 90 is replaced by a transverse slot 118 formed in the band adjacent but spaced from the opening in the bottle hoop 116. The spout hoop 114 can be slipped forcibly through the slot 118 by flexing the loop in order to thread the tether 110 onto itself. The size of the spout hoop 114 can be larger than the slot width to retain the tether in the threaded condition.

In FIG. 12, a tether 120 is shown to also be similar to the previously described tethers in overall configuration. In this example, the tether 120 also has a band 122, a spout hoop 124 at one end of the band 122, and a bottle hoop 126 at the other. The edges of the band, the spout hoop, and the bottle hoop each have an enlarged, ribbed bead that can add to the aesthetics of the tether, as well as to impart some rigidity or resiliency to the flexible band material. Also in this example, the notch 90 and slot 118 described above are replaced by a T-shaped slot 130. The slot 130 in this example has a leg 132 extending lengthwise along the portion of the band 122 and a laterally extending leg 134 that is spaced closer to the bottle hoop 126. The longitudinal leg 132 of the slot 130 can be sized to accept the spout hoop 124 therethrough without having to deform the spout loop. Instead, the band need only be twisted so that the hoop 124 is oriented sideways for insertion through the slot 130. The band 122 can then be forcibly seated into the lateral leg 134 of the slot 130. The width of the lateral leg 134 can be narrower than the size of the spout loop 124 to thus retain the threaded condition for the tether 120.

In FIG. 13, another alternate tether 136 is illustrated and has an even simpler construction, but is similar to the tether 110 in FIG. 11. In this example, the slot 118 is replaced by a simple rectangular notch 138 at the end of the band 140 and opening into a bottle connector hoop 142. A spout connector hoop 144 is at the other end of the band 140 and can be passed through the bottle hoop 142. The width of the notch 138 can be sized to closely match that of the width of the band 140 to assist in retaining the threaded configuration of the tether 136. As will be evident to those having ordinary skill in the art upon reading the forgoing, the configuration and construction of the band of the tether can vary within the spirit and scope of the present invention. The tether need only thread onto itself or otherwise be looped unto itself in order to function in accordance with the teachings of the present invention.

FIGS. 14 and 15 illustrate another example of a drinking container 150 constructed in accordance with the teachings of the present invention. In this example, the drinking container 150 includes a bottle 152 that is essentially identically to the bottle 32 as previously described, except that the bottle 152 is shown in FIG. 14 as being transparent. The bottle 32 described above can either be opaque or transparent, as can the bottle 152. The drinking container 150 includes a cap assembly 154 that is also essentially identical to the previously described cap assembly 34, except that in this example a water filter assembly 156 is connected to the cap assembly 154. With respect to the container 150, like reference numerals are used for like parts in comparison to the previously described drinking container 30. New reference numbers are introduced for parts that are different or in addition to the prior described container. Thus, the cap 50, tether 70, and spout cover 56 are essentially identical to the prior cap assembly 34.

FIG. 16 shows that the filter assembly 156 is attached to an underside of a top panel 157 of the cap assembly 154. The cap skirt 54 depends downward from the top panel 158 and also has mechanical threads 60 on its interior surface. FIGS. 17 and 18 illustrate details of the filter assembly 156. In the disclosed example, the filter assembly 156 generally has a filter media 158 housed within a cage or filter housing 160. The cage 160 in this example has a removable bottom 162 and an upper body 164. The upper body 164 in this example generally has a side wall 166, a top wall 168, and a connector 170 extending upward from the top wall. The connector 170 is generally cylindrical and has male mechanical threads on 172 on the exterior surface. The interior of the upper portion 164 of the cage 160 and interior of the cylindrical connector 170 are hollow in this example. A top surface 174 on the free end of the connector 170 forms a grate and a plurality of grate openings 176 are formed through the top surface. A plurality of flow openings 178 are formed through the side wall 166 of the cage in this example. The flow openings communicate between the exterior and interior of the upper body 164 of the cage 160.

The bottom 162 of the cage 160 is configured to snuggly fit within an opening in the bottom of the upper portion and close off the opening. In this example, an annular upstanding ring 180 projects upward from the interior side of the bottom 162. A seal or O-ring 182 is carried on the exterior surface of the annular ring. The seal seats against an interior surface on the open end of the upper body 164 on the cage when the bottom is installed. A check valve 184 is seated in a small opening at the center of the bottom 162. In this example, the filter media 158 is configured as an open cylinder as shown in FIG. 18. A smaller diameter upstanding wall 186 extends up from the bottom 162 within the annular ring 180 and defines a channel 188 therebetween on the interior surface of the bottom 162. This channel 188 assists in seating the filer media 158 on the bottom 162 and retaining the filter media in position when the filter assembly 156 is assembled.

The present invention is not intended to be limited by any particular type of filter media 158 used within the filter assembly 156 disclosed above. There are many different types of water filtration media available in the market and more being developed. For example, charcoal type filters are known that can filter various contaminants from water sources. Also, porous plastic filters impregnated with substances capable of filtering contaminants from water are also known. Further, filter media made from natural or man-made fabrics, woven materials, and nonwoven materials are also known. These types of woven and nonwoven filter media have fibers that can be impregnated with substances capable of filtering contaminants from water. Some filter media types, such as charcoal filters do have a tendency to have larger sized particles or chunks break off from the media and to have much smaller size particles or fines become detached from the media. Other types of filter media may or may not have similar problems. Virtually all of these types of filter media have a finite useful life. At some point, the filtering capabilities of the media will deteriorate to the point that the filter is ineffective or where the filtering capabilities of the media are spent. Once the filtering media reaches this point in its useful life, the media must be replaced.

With reference to FIGS. 17-20, the disclosed filter assembly 156 can be provided with an optional replacement indicator to help the user to determine when it is time to change the filter media 158 within in the assembly 156. In the disclosed example, a circumferential ridge 190 is formed on the outer surface of the filter connector 170 and is spaced upward from the top wall 168 on the cage 160. A groove 192 is formed below the ridge 190 on the connector. An indicator ring 194 is depicted in FIGS. 17-20 and in this example has a generally circular configuration with a central opening 196. The central opening 196 is sized to interferingly fit over the ridge 190 on the connector 170 and to seat in the groove 192 on the filter assembly 156. The diameter of the groove 192 and central opening 196 in the indicator ring 194 can be cooperatively sized to allow the indicator ring to permit rotation relative to the cage 160.

In the disclosed example, the underside of the ring 194 and/or the top wall 168 of the filter cage 160 can be provided with cooperating projections, bumps, protrusions, recesses, detents, dimples, and/or the like. With such features, the ring can provide positive, tactile feedback for the user during rotation to help the user orient the ring in a selected orientation. Such features can also operate to assist in retaining the ring in the selected position, once the ring achieves the desired position.

A top surface of the indicator ring 194 in this example can have raised indicia 198 or markings thereon. The indicia 198 can represent various time increments relevant to a particular filter media and can vary within the spirit and scope of the present invention. In one example, the indicia 198 as shown in FIG. 19 can include a plurality of primary indicia markings 200 with the numbers 01-12 associated therewith. These numbers can indicate, for example, each month of a calendar year. The indicia also have secondary indicia 202 spaced intermittently between the primary indicia 200. The indicia can change according to the needs of a particular filter application. As depicted in FIGS. 17-19, a marker or bump 210 can be provided on a surface of the side wall 166 on the cage 160. A selected one of the primary markings 200 or secondary markings 202 of the indicia 198 on the indicator ring 194 can be aligned with the marker 210 as selected by a user. The aligned marker and indicia marking can provide an indication to that user when to change the filter media 158.

The user can be provided with life expectancy information for the filter media, depending on various degrees of use of the drinking container 150. Before installing a new filter media 158, the user can rotate the ring in this example to align one of the markings 200 or 202 with the marker 210 on the case 160. The ring can be positioned to indicate the approximate date that the new filter is placed in the bottle. Knowing the expected filter life, the user can then determine when to change the media. Alternatively, the ring can be positioned to indicate the approximate expiration or spent date of the filter medium. In either case, the user can use the indicator, coupled with a known or estimated filter expected life, to determine when next to replace the filter medium.

In another example, the entire housing and filter assembly can be a replaceable item, if desired. The size, shape, style, functionality, and the like of the marker 210, the ring 194, and the indicia 198 can vary from the example shown within the spirit and scope of the invention. As will be evident to those of ordinary skill in the art, the date or time feature can also vary from the monthly indicia on the ring example disclosed herein.

FIG. 21 shows a cross-section of the cap assembly 154 and bottle 152 of the drinking container 150. As shown therein, the cap assembly 154 can be provided with a filer receptacle 212 on the underside of the top panel 157. In this example, the receptacle 212 can be formed as a cylinder with internal female mechanical threads 214 to mate with the threads 172 on the filter connector 170. Thus, the filter assembly 156 can be entirely removable, interchangeable, rechargeable, or the like relative to the cap assembly 154 in this example. The cap assembly 154 can also be used with no filter assembly, if desired. In an alternate embodiment, a portion of the filter assembly housing or cage 160 can be formed integral with the cap assembly and another portion can be detachable to permit insertion and removal of the filter media 158 in order to recharge the filter assembly.

Also as depicted in FIG. 21, the bottle connector hoop 78 is shown seated under the annular rib or flange 80 on the neck 40 of the bottle 152, as described above. Further, as is indicated in this figure, the flow openings 178 in the side wall 166 on the cage provide flow access to the filter media 158 within the assembly 156. Also as shown in FIG. 21, an annular wall 218 can depend down form the underside of the top wall 168 on the cage upper body 164. A second channel 220 can be formed between the annular wall 218 and an interior side of the cage side wall 166. The filter media 158 in this example can thus also be seated and retained in the second channel 220 when installed within the cage 160 to further retain the filter media in position during use.

FIG. 21 also illustrates that the grate openings 176 in the top end of the filter assembly are in the flow path defined by the spout 58 in the bottle 152 and the connector 170 on the filter assembly 156. Depending upon filter type, the grate openings 176 can be configured, position, and sized so as to block the passage of a larger chunks of filter material from entering the water stream to be consumed by a user. As noted above, charcoal type filters are known to lose chunks of filter material on occasion. As will be evident to those having ordinary skill in the art, the number, size, placement, configuration, and the like of the grate openings 176 can vary within the spirit and scope of the present invention. In the example shown in FIGS. 18 and 19, the grate openings 176 vary in size and are arcuate in shape. FIG. 22 illustrates a top end view of a portion of an alternate filter assembly 228 with a modified pattern of grate openings 230. The grate openings 176 can be molded as part of the dispensing opening at the top of the filter cage 160 as shown. Alternately the grate openings 176 can be formed integrally or separately inserted within the flow path of the cap assembly spout 58, if desired.

As depicted in FIGS. 23 and 24, the filter assembly 156 can be further modified to include a paper liner material 232 positioned on the exterior side of the filter media 158 as well as on the interior side. The paper liner can be an additional filter designed to eliminate smaller sized particles from the water stream. As noted above, filter media such as charcoal filters also have a tendency to lose very small particles or fines during use. The paper liners can be of a type to filter out particles down to a specific particle size. The liners can be positioned to eliminate or significantly reduce passage of fines to the outgoing water stream (interior liner FIG. 23) or to eliminate or reduce fines being dropped into the liquid in the bottle (exterior liner FIG. 24). The paper liner material 232 can be optionally used on the exterior side, the interior side, or both of the filter media in this example. Providing the paper liner on both sides of the filter media can assist in preventing fines from entering the water within the bottle as well as entering the water stream exiting the bottle. One difficulty with adding an additional filter layer such as paper liners is that the additional layers can increase the resistance to water flow through the filter assembly. Simply adding the filter assembly 156 can also reduce flow of water being dispensed to a user.

FIG. 23 shows a cross-section in FIG. 21 with the drinking container 150 in an inverted orientation. As illustrated, water can flow from the bottle only through the flow openings 178 and the side wall 166 of the filter cage 160. Water is prevented from blowing through the bottom 162 of the filter cage by the check valve 184. In this orientation, the check valve will close and prevent water from bypassing the check valve. The filter assembly in this example can include weep holes 234 in the bottom 162 to allow for drainage of water from the filter cage when the bottle is returned to the upright position of FIG. 24. The weep holes 234 in this example are illustrated in FIG. 16 and can be aligned with a bottom edge of the filter media 158. Thus, even if water enters the filter assembly 156 through the weep holes 234, the water will have to pass through the filter media before exiting the bottle 152.

FIG. 24 shows the cross-section in FIG. 21 with the drinking container 150 in an upright position. As illustrated, air can flow into the bottle through the spout 58 and bypass the filter assembly 156 via the check valve 184. The check valve can be configured to open as needed to permit air to freely enter the bottle if evacuated of liquid and/or air during use. In this orientation, the check valve 184 is free to open by gravity or a pressure differential between the atmosphere and the evacuated interior of the bottle 152. The one-way check valve 184 aids the bottle 152 in rebounding by increasing the volume and/or velocity of air can travel back into the bottle through the filter assembly 156. The air can return directly through the check valve 184 in the bottom 162 of the cage 160, bypassing the filter media as illustrated in FIG. 24.

In the disclosed example, the bottle 152 can be configured to assist in dispensing water through the filter assembly 156, with or without the paper liners 232, and can assist in the bottle snapping back or rebounding after a squeeze to its expanded normal state shown in figures. With reference to FIGS. 14, 25, and 26, the bottle 152 can be fabricated from a resilient flexible plastic material that permits the bottle to be squeezed. Thus, a user can invert the bottle to the configuration in FIG. 23 and squeezed the bottle to dispense water. The bottle 152 has a tapered waist section 240 that narrows along one horizontal axis at about a midpoint of the bottle (FIG. 25). The waist section 240 in another horizontal axis normal to the axis of paper, the bottle is not so tapered.

A vertically elongate recess 242 is positioned on each of those two opposed sides of the bottle 152. Each of the recesses 242 is bounded by a vertical rib 244 on either side. The recess and rib configuration on these sides of the bottle and resiliency and resistance to squeezing. Thus, when a user squeezes the bottle, the recesses and ribs will assist to rebound the bottle to its original shape immediately upon release of the squeeze. The narrowed waist section 240 also provides a comfortable gripping section for the user. The user can easily grip the bottle at the tapered waist section and squeeze the bottle on the smooth, non-ribbed sides to dispense water. The shape of the bottle 152 and the recesses 242 and ribs 244 will encourage the bottle to quickly snap back or rebound.

Figure 27:
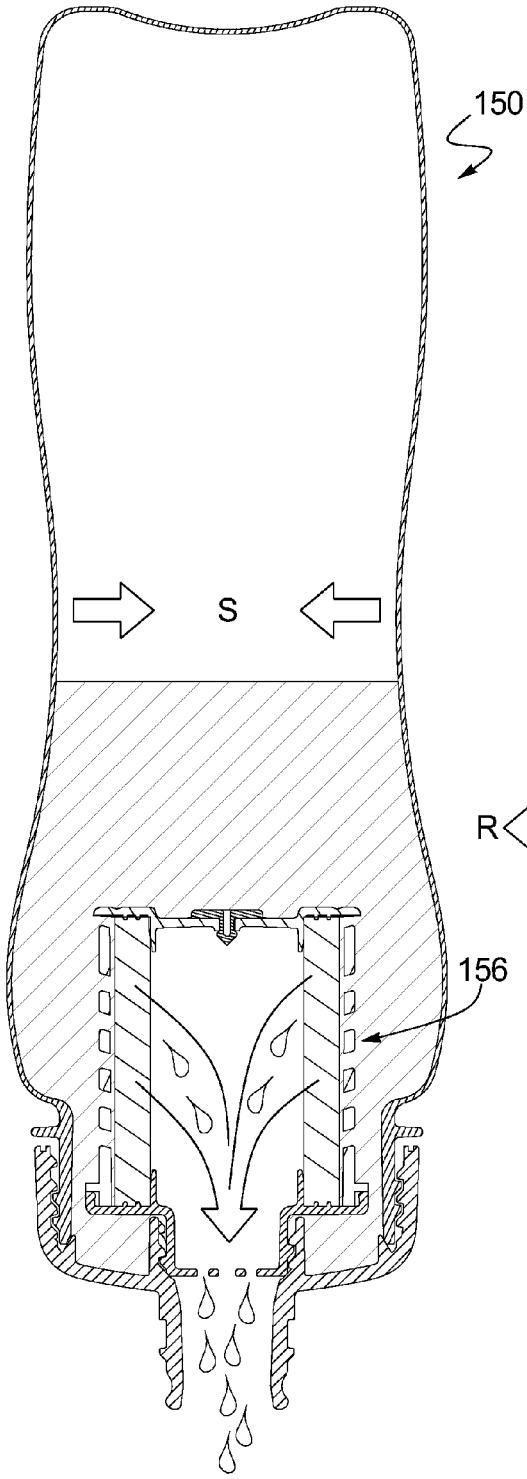
FIG. 27 shows the inverted drinking container cross-section in FIG. 23 and depicts the water flow and bottle squeeze action for dispensing water from the bottle.
Figure 28:
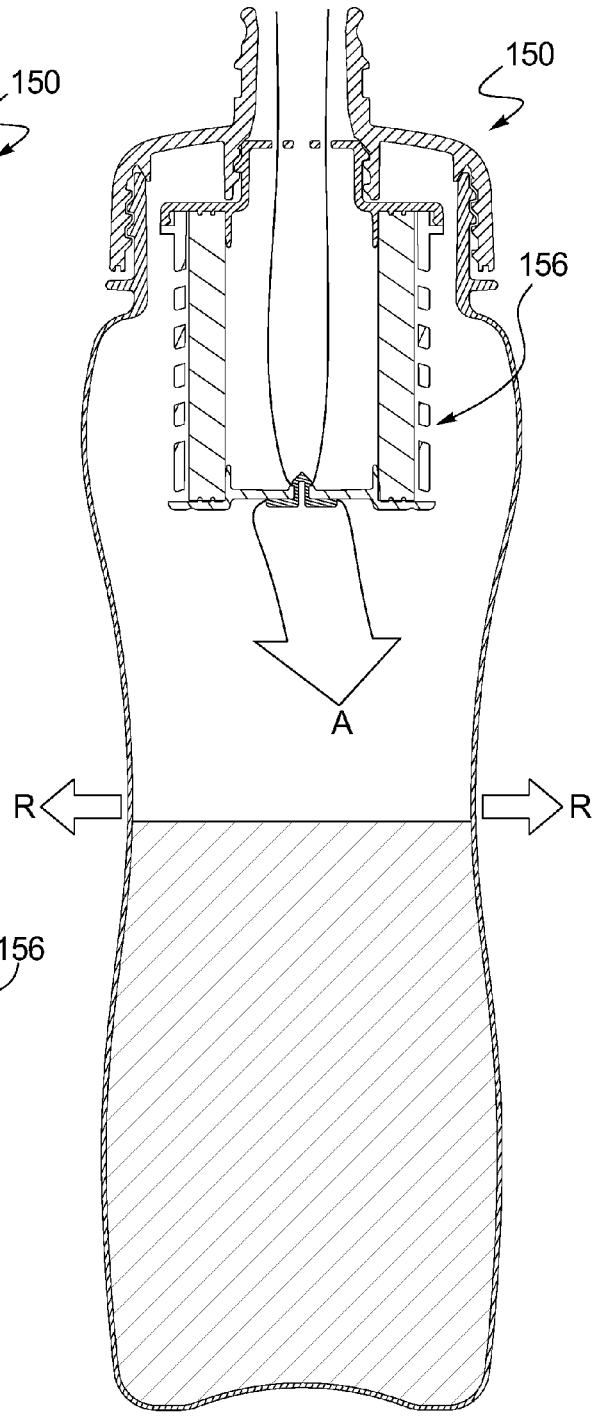
FIG. 28 shows the upright drinking container cross-section in FIG. 24 and depicts the return airflow and the bottle rebound effect.

FIG. 27 shows the bottle 152 inverted orientation of FIG. 23 being squeezed in the direction of the arrows S at the tapered waist section 240. Water is then dispensed through the filter assembly 156 and out the spout 58. FIG. 28 shows the bottle 152 upon being returned to the upright orientation. The waist section 240 rebounds in the direction of the arrows R an air flows back into the evacuated bottle downward through the filter assembly 156 and the check valve 184. The filter media 158 as disclosed herein need not be a hollow circular cylinder, but instead can be a solid body and/or a different shape from that shown. The configuration of the media 158 functions well with the disclosed filter assembly and its various features.

The contours of the bottle 152 (and the bottle 32) can be designed to minimize squeeze force and improve rebound speed during use. In this example, the bottle 152 has a non-round cylinder shape as best illustrated in FIG. 26. The bottle surfaces can include elongate concavities, depressions, ribs, or other indentations or projections, different from the recesses 242 and ribs 244 shown and described herein. These devices can encourage the flexible bottle to "snap back" to its original shape after being squeezed. Thus, a user can have the ability to squeeze the bottle quickly and repeatedly. The snapping action increases the speed at which air returns to the interior space of the bottle, also aided by air return facilitated by the one-way check valve. The indentations can also assist in giving the user an improved grip of the bottle.

The filter assembly 156 can snap onto, thread onto or into, or otherwise attach to the underside of the cap assembly 154. This positions the filter assembly 156 in the flow path or outlet orifice of the bottle as shown. The filter assembly 156 can be easily removed, recharged, or replaced as needed. Alternatively, the disclosed drinking container 150 may optionally be assembled without the filter assembly and still be used for drinking, especially for beverages other than water. The container would then be identical to the container 30 described above. The tether arrangement can also be employed with or without the filter assembly on the cap assembly and the filter assembly can be employed with or without the tether arrangement.

A variety of materials and manufacturing methods can be used to fabricate the various components of the disclosed drinking containers. The tether straps can be injection molded from a flexible polyethylene, such as a LLDPE or other suitable material. The strap could alternatively be made of nylon, neoprene, or any other flexible materials suitable for straps. The filter housing materials and manufacturing methods can vary widely. The venting and "screening" details can be features that are integrally molded into the components or added as secondary processes or parts. The one-way vent or check valve can be fabricated from plastic and/or silicon, or other materials or material combinations. The valve can be snapped into place and capable of moving between open and closed positions (the valve shown in the FIGS. herein is generically shown as having only one position but in practice would be capable of opening and closing). The bottle materials and manufacturing methods can also vary widely, but the bottle is preferably squeezable and thus formed of a flexible material, such as polyethylene or polypropylene.

The disclosed tether keeps the cap assembly connected to the bottle during refilling of the bottle. The tether also keeps the spout cover out of the way while a user drinks from the bottle. The tether also keeps the spout cover connected to the bottle during use so that it is not lost when the bottle is opened. The looped band of the tether also creates a handle or hanger feature. The disclosed bottle assists a user in quickly and repeatedly drinking from the filtered bottle without a high squeeze force and long delays between drinks. The filtered bottle also allows a user to take water from many sources without having to worry about the cleanliness of the source.

Although certain bottles, cap assemblies, cap tethers, and filter assemblies and features have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A drinking container comprising:

a bottle having an open top;

a cap assembly attachable to the bottle to cover the open top and having a drinking spout with a top opening;

a spout cover removably fitted on the top opening of the drinking spout; and a flexible tether with an elongate band, a first hoop at a first end, and a second hoop at a second end, and having the first hoop connected to the spout cover and the second hoop connected to a portion of the drinking container, wherein the tether is looped unto itself forming a variable sized loop between the first end and the second end permitting the spout cover to be extended to close off the top opening and to be retracted withdrawing and retaining the spout cover to a position remote from the drinking spout.

2. A drinking container according to claim 1, wherein the first hoop is a spout hoop seated in a groove formed on the spout cover.

3. A drinking container according to claim 2, wherein the spout cover can rotate relative to the spout hoop.

4. A drinking container according to claim 1, wherein the second hoop is a bottle connector hoop seated in a groove formed on a neck of the bottle.

5. A drinking container comprising:

a bottle having an open top;

a cap assembly defining a drinking spout and configured to removably attach to the bottle to cover the open top; and a tether having an elongate band with a first end, a second end, a first hoop at the first end connected to a portion of the cap assembly, and a second hoop at the second end connected to a portion of the drinking container, wherein the band is threaded unto itself to form a loop in the tether between the first hoop and the second hoop permitting the portion of the cap assembly to be slid between an extended position spaced from the band and a remote position held closely adjacent the band, whereby the loop is smaller in diameter in the extended position and larger in diameter in the remote position.

6. A drinking container according to claim 5, wherein the second hoop is seated in a groove on a neck that defines the open top of the bottle.

7. A drinking container according to claim 5, wherein the portion of the cap assembly is a spout cover that removably attaches to the drinking spout, and wherein the first hoop and the spout cover are rotatably connected to one another.

8. A drinking container according to claim 5, wherein the first hoop is threaded through the second hoop to create the loop in the band.

9. A drinking container comprising:

a bottle having an open top;

a cap assembly defining a drinking spout and configured to removably attach to the bottle to cover the open top; and a tether having an elongate band with a first end, a second end, a first hoop at the first end connected to a portion of the cap assembly, and a second hoop at the second end connected to a portion of the drinking container, wherein the band is threaded unto itself to form a loop in the tether permitting the portion of the cap assembly to be slid between an extended position spaced from the band and a remote position held closely adjacent the band, whereby the loop is smaller in diameter in the extended position and larger in diameter in the remote position, wherein the first hoop is threaded through the second hoop to create the loop in the band, and wherein the band is slidably seated in a notch formed into an inner edge of the second hoop.

10. A drinking container according to claim 9, wherein the notch is positionally aligned with where the band is joined to the second hoop.

* * * * *